US009611766B2

(12) United States Patent
Kroos et al.

(10) Patent No.: US 9,611,766 B2
(45) Date of Patent: Apr. 4, 2017

(54) GAS EXCHANGE VALVE OF AN INTERNAL COMBUSTION ENGINE

(71) Applicant: Mahle International GmbH, Stuttgart (DE)

(72) Inventors: Peter Kroos, Rutesheim (DE); Christoph Luven, Stuttgart (DE); Alexander Mueller, Wildberg (DE); Alexander Puck, Esslingen (DE)

(73) Assignee: Mahle International GmbH (DE)

( * ) Notice: Subject to any disclaimer, the term of this patent is extended or adjusted under 35 U.S.C. 154(b) by 113 days.

(21) Appl. No.: 14/301,779

(22) Filed: Jun. 11, 2014

(65) Prior Publication Data

US 2014/0360447 A1 Dec. 11, 2014

(30) Foreign Application Priority Data

Jun. 11, 2013 (DE) ..... 10 2013 210 900

(51) Int. Cl.

| | |
|---|---|
| ***F01L 1/18*** | (2006.01) |
| ***F01L 3/20*** | (2006.01) |
| ***F01L 3/00*** | (2006.01) |
| ***F01L 3/14*** | (2006.01) |

(52) U.S. Cl.
CPC *F01L 3/20* (2013.01); *F01L 3/00* (2013.01); *F01L 3/14* (2013.01)

(58) Field of Classification Search
CPC ..... F01L 3/20; F01L 3/14; F01L 3/00
USPC ..... 123/90.45
See application file for complete search history.

(56) References Cited

U.S. PATENT DOCUMENTS

| | | | | |
|---|---|---|---|---|
| 1,786,285 | A * | 12/1930 | Bissell | F01L 3/14 123/41.16 |
| 6,099,668 | A | 8/2000 | Ueta et al. | |
| 6,354,258 | B1 | 3/2002 | Abele et al. | |
| 6,935,296 | B2 * | 8/2005 | Abele | F01L 3/00 123/188.3 |
| 7,603,976 | B2 | 10/2009 | Abele | |

(Continued)

FOREIGN PATENT DOCUMENTS

| | | | |
|---|---|---|---|
| DE | 2361712 | A1 | 2/1975 |
| DE | 19731382 | A1 | 1/1999 |

(Continued)

OTHER PUBLICATIONS

Abstract of JP 11006407 A listed above, Jan. 1999.*

(Continued)

*Primary Examiner* — Zelalem Eshete
(74) *Attorney, Agent, or Firm* — Fishman Stewart PLLC

(57) ABSTRACT

A gas exchange valve of an internal combustion engine may include a hollow valve stem and a valve disc. The valve disc may include a valve bottom and a hollow valve cone which is connected to an outer edge of said valve bottom. The hollow valve cone may taper with increasing distance from the valve bottom. The valve stem may pass through the hollow valve cone. The valve stem may be fixedly connected on the one hand to the valve bottom and on the other hand to the tapered end of the valve cone. The valve stem may include a first hollow space which is fluidically separated from a second hollow space arranged in the valve disc. The first hollow space and the second hollow space may have a different cooling agent filling level.

20 Claims, 1 Drawing Sheet

(56) References Cited

U.S. PATENT DOCUMENTS

| | | | | |
|---|---|---|---|---|
| 2006/0005792 | A1* | 1/2006 | Bosler | B23K 11/26<br>123/41.41 |
| 2006/0278193 | A1* | 12/2006 | Abele | F01L 3/00<br>123/188.3 |
| 2008/0149062 | A1 | 6/2008 | Luepfert | |

FOREIGN PATENT DOCUMENTS

| | | | |
|---|---|---|---|
| DE | 19804053 | A1 | 8/1999 |
| DE | 69710409 | T2 | 11/2002 |
| DE | 102004010309 | A1 | 9/2005 |
| DE | 102005013088 | A1 | 9/2006 |
| DE | 102005027130 | | 12/2006 |
| JP | 11006407 | A * | 1/1999 |

OTHER PUBLICATIONS

English abstract for DE19731382.
English abstract for DE102004010309.
German Search Report for DE102013210900.8.

* cited by examiner

GAS EXCHANGE VALVE OF AN INTERNAL COMBUSTION ENGINE

CROSS-REFERENCE TO RELATED APPLICATIONS

This application claims priority to German Patent Application DE 10 2013 210 900.8 filed Jun. 11, 2013, which is hereby incorporated by reference in its entirety.

TECHNICAL FIELD

The present invention relates to a gas exchange valve of an internal combustion engine with a hollow valve stem and a valve disc according to the preamble of claim 1. The invention additionally relates to an internal combustion engine with at least one cylinder and with at least one such gas exchange valve.

BACKGROUND

From DE 10 2004 010 309 A1 a generic gas exchange valve of an internal combustion engine with a hollow valve stem and a valve disc is known. The valve disc in this case comprises a valve bottom, which on its outer edge is connected to a hollow valve cone. The valve cone in turn tapers with increasing distance from the valve bottom. The valve stem passes through the hollow valve cone and in each case is connected in a fixed manner on the one hand to the valve bottom and on the other hand to the tapered end of the valve cone. In order to be able to improve such a gas exchange valve with respect to its stability and fatigue strength, the valve bottom in the annular region located between its connection to the valve stem on the one hand and the valve cone on the other hand radially adjacently comprises at least one annular bead with a cross-sectional surface running convexly to the outside.

From DE 198 04 053 A1 a further gas exchange valve in the manner of a lightweight construction valve for an internal combustion engine with a ratio of wall thickness to stem diameter of less than 1:3 is known. This is to minimise deformations of a valve head, i.e. of the valve disc, in particular. In order to support this, the valve disc supports itself against the valve stem either directly or via an intermediate piece.

SUMMARY

The present invention deals with the problem of stating an improved or at least an alternative embodiment for a gas exchange valve of the generic type, which is characterized in particular by improved cooling and because of this by improved fatigue strength.

According to the invention, this problem is solved through the subjects of the independent claims. Advantageous embodiments are subject of the dependent claims.

The present invention is based on the general idea of providing two hollow spaces which are fluidically separated from one another in a hollow gas exchange valve of an internal combustion engine known per se, namely a first hollow space in a valve stem and a second hollow space in a valve disc. Through the fluidic separation of the two hollow spaces according to the invention, different cooling agent filling levels can be realised in the gas exchange valve according to the invention in the individual hollow spaces, as a result of which a particularly effective cooling of the gas exchange valve compared to hollow valves known up to now which merely comprise one hollow space. The gas exchange valve according to the invention in this case comprises the previously mentioned hollow valve stem in the known manner and a valve disc following thereon, wherein the valve disc comprises a valve bottom and a hollow valve cone connected to the outer edge of the valve bottom, which hollow valve cone tapers with increasing distance from the valve bottom. The valve stem passes through the valve cone and is connected in a fixed manner in each case on the one hand to the valve bottom and on the other end to the tapered end of the valve cone. Here, the valve stem is connected to the valve bottom on the face end adjoining the valve bottom in a fluid-tight manner, so that an exchange of fluid between the first hollow space arranged in the valve stem and a second hollow space arranged in the valve disc is not possible. Through the fluidic separation of the two hollow spaces it is now possible for example to provide a comparatively low cooling agent filling level in the second hollow space, whereas the cooling agent filling level in the first hollow space is significantly higher. Through the different cooling filling levels however a so-called shaker effect can be achieved in both hollow spaces, through which the cooling agent during the operation of the internal combustion engine is shaken and because of this can develop its full cooling effect. In particular, with the gas exchange valve according to the invention, a complete emptying of the valve head, i.e. of the valve disc, can no longer occur because of the previously mentioned shaker effect, since the cooling agent which is arranged in the second hollow space in the valve disc can no longer be discharged into the valve stem as is the case up to now.

With an advantageous further development of the solution according to the invention a cooling agent is filled into at least one hollow space, in particular at least in the first hollow space. Preferentially, however, a cooling agent is present in both hollow spaces, wherein the cooling agent filling level in the second hollow space is significantly lower than the cooling agent filling level in the first hollow space. If for example both hollow spaces are each filled to a third with cooling agent, the shaker effect which supports the cooling effect can be fully utilised.

Practically, the cooling agent comprises sodium. Sodium already melts at 98° C., but only boils at 883° C. Because of a heat conductivity of 140 W/mK, sodium has excellent heat transfer characteristics and a low melting point with a large liquid range at the same time. The heat conductivity in this case is significantly above that of steel, so that heat dissipation, for example from the valve bottom to the valve cone, and from the valve bottom into the valve stem, is favoured. By connecting the valve stem to the valve bottom an optimised heat transfer is also possible here.

With another advantageous embodiment of the solution according to the invention, at least the valve disc of the gas exchange valve is nitrided. Nitriding the valve disc can for example take place by means of bath or plasma nitriding, as a result of which approximately 1-20 μm thick nitriding layers form, which create a very high surface layer hardness. This very hard surface layer brings about a high wear resistance of the valves. Obviously, the valves cannot only be nitrided in the region of the valve disc but throughout the region, i.e. additionally also in the valve stem region.

With a further advantageous embodiment of the gas valve according to the invention, the valve stem on its end that is connected to the valve bottom has a larger diameter than in its connecting region to the valve cone. Because of this, a significantly improved supporting of the valve bottom in its central region can be achieved, as a result of which in turn the stability of the gas exchange valve according to the invention can be increased.

Practically, an inner diameter of the first hollow space, i.e. of the hollow space in the valve stem, comprises at least two thirds of an outer diameter of the valve stem. Because of this, a particularly thin-walled formation of the valve stem can be achieved by means of which not only a comparatively lightweight gas exchange valve can be produced but also optimised heat dissipation out of the region of the valve disc can be achieved. The same positive effects can be achieved for example through a reduced wall thickness of the valve cone, wherein a wall thickness of less than 1 mm is to be aimed at here.

With a further advantageous embodiment of the solution according to the invention, the gas exchange valve is at least partially formed of a 601H-steel (UNS N06601), an 800H-steel (UNS N08810 or material numbers 1.4876/1.4958), a 286-steel (UNS S66286) or a 602H-steel (UNS N06025). The steels are characterized by a high temperature resistance, strength and good weldability.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawing and are explained in more detail in the following description, wherein same reference numbers relate to same or similar of functionally same components.

BRIEF DESCRIPTION OF THE DRAWINGS

It shows, in each case schematically

DETAILED DESCRIPTION

Figure 1:
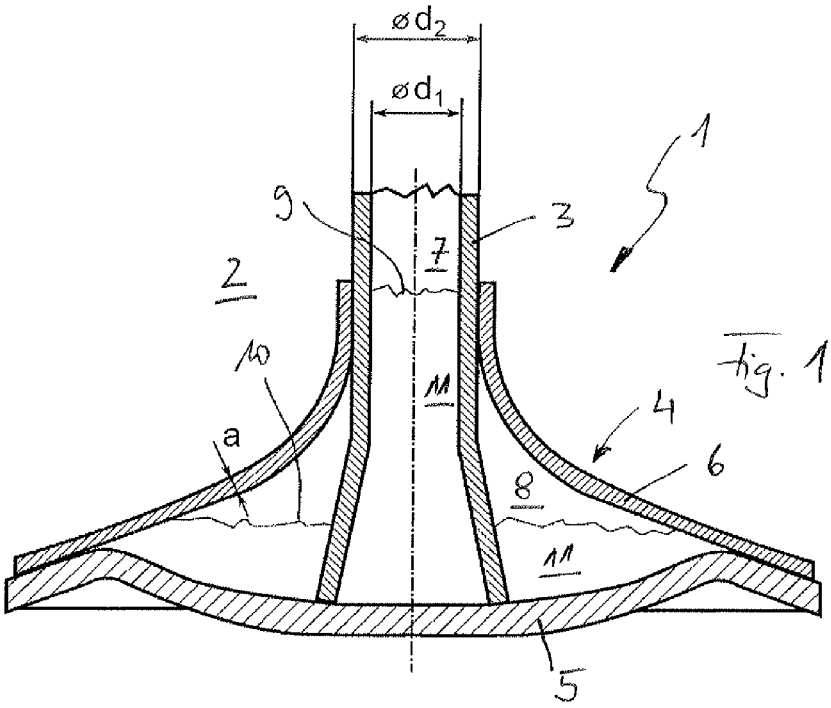
FIG. 1 a detail representation through a gas exchange valve according to the invention in the region of a valve disc, FIG. 2 a view of a gas exchange valve according to the invention with exclusively nitrided valve disc, FIG. 3 a representation as in FIG. 2, however with completely nitrided gas exchange valve, FIG. 4*a* a sectional representation as in FIG. 1, wherein a cooling agent is filled in exclusively in the first hollow space in the valve stem, FIG. 4*b* a representation as in FIG. 4*a*, wherein however a cooling agent is exclusively filled into the second hollow space in the valve disc, FIG. 4*c* a representation as in FIG. 1, wherein both the first as well as the second hollow space contain cooling agent.
Figure 4:
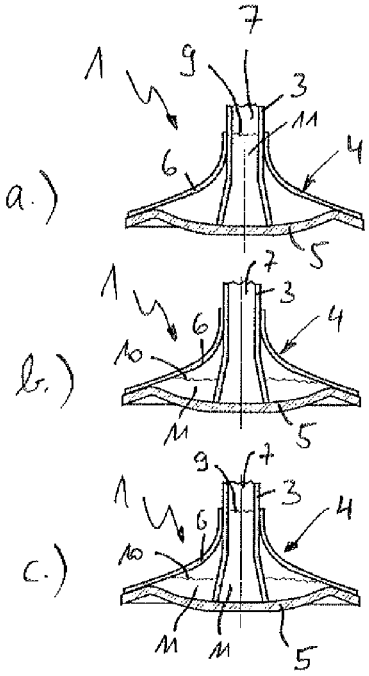

According to FIGS. 1 and 4, a gas exchange valve 1 according to the invention of the internal combustion engine 2 comprises a hollow valve stem 3 and a valve disc 4. The valve disc 4 comprises a valve bottom 5 and a hollow valve cone 6 which is connected to the outer edge of said valve bottom 5, which hollow valve cone 6 tapers with increasing distance from the valve bottom 5. Here, the valve bottom is assigned in known manner to a combustion chamber of the internal combustion engine 2. Now, the fact that in the valve stem 3 a first hollow space 7 is provided, which is fluidically separated from a second hollow space 8 arranged in the valve disc 4, is in accordance with the invention. In addition, the first hollow space 7 and the second hollow space 8 have a different cooling agent filling level 9 and 10 respectively. Through the fluidic separation of the two hollow spaces 7 and 8 a so-called shaker effect can be achieved in both hollow spaces 7, 8, which makes possible an optimised heat dissipation from the valve bottom 5 in the direction of the valve cone 6 or of an upper end of the valve stem 3.

A different cooling filling level 9, 10 in this case can also mean that no cooling agent 11 is filled into one of the two hollow spaces 7, 8 and because of this the cooling agent filling level 9, 10 amounts to zero, while in the other hollow space 8, 7 cooling agent 11 is filled in.

Now looking at FIG. 4*a* it is evident that with this gas exchange valve 1 cooling agent 11 is filled exclusively into the first hollow space 7, wherein the second hollow space 8 does not contain any cooling agent. According to FIG. 4*b*, a cooling agent 11 is exclusively filled into the second hollow space 8, whereas the first hollow space 7 in the valve stem 3 does not contain any cooling agent 11. According to FIG. 4*c* the filling level shown according to FIG. 1 is shown, wherein cooling agent 11 is filled into both the first hollow space 7 as well as into the second hollow space 8, with different cooling agent filling level 9, 10.

The cooling agent 11 can for example be sodium or comprise sodium, as a result of which a particularly optimised heat conductance can be achieved.

Figure 2:
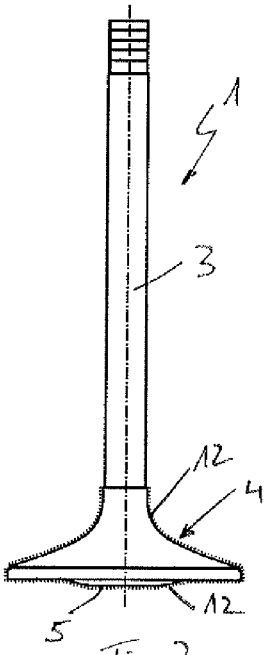
Figure 3:
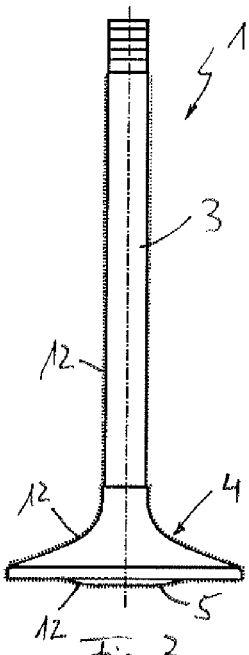

In order to additionally form the gas exchange valve 1 more wear-resistant, at least the valve disc 4 can be nitrided, i.e. comprise a surface nitration 12, as it is shown according to FIG. 2, wherein it is alternatively also conceivable that the entire gas exchange valve 1 is nitrided, i.e. has such a surface nitration 12. Through the superficial nitriding of the valve disc 4 or additionally of the valve stem 3 the hardness in this surface layer can be significantly increased.

Looking again at FIG. 1 it is evident that a wall thickness a in the region of the valve cone 6 is formed as small as possible, in particular less than 1 mm, as a result of which a particularly lightweight gas exchange valve 1 can be produced. In addition, an inner diameter $d_1$ of the first hollow space 7 in the valve stem 3 can also amount to two thirds of an outer diameter $d_2$ of the valve stem 3, as a result of which material and thus weight can likewise be saved.

As material for the gas exchange valve according to the invention 601H-steel, 800H-steel, 286-steel or 602H-steel can be used for example, as a result of which the following advantages can be achieved: high temperature resistance, strength and good weldability.

Finally, looking at the valve stem 3 according to FIGS. 1 and 4 it is evident that said valve stem 3 at its end with which it is connected to the valve bottom 5 has a larger diameter than in its connecting region to the valve cone 4, as a result of which an improved support of the valve bottom 5 is achieved in particular and thus a particularly stable gas exchange valve 1 can be achieved.

Through the gas exchange valve 1 according to the invention it is possible to embody it not only particularly light in weight but additionally with an optimised cooling, which brings with it advantages with respect to the wear and to the operation of the internal combustion engine 2.

The invention claimed is:

1. A gas exchange valve of an internal combustion engine, comprising:

a hollow valve stem having a longitudinal axis and a valve disc, the valve disc includes a valve bottom and a hollow valve cone, the valve cone connected to an outer edge of said valve bottom, wherein the hollow valve cone tapers with increasing distance from the valve bottom, and the valve stem passes through the hollow valve cone, wherein the valve stem is fixedly connected at an end face to the valve bottom to define a fluid-tight connection and in a region axially spaced from the end face to the tapered end of the valve cone, wherein the valve stem includes a first hollow space, which is fluidically separated and radially inward from a second hollow space arranged in the valve disc via the fluid-tight connection between the end face of the valve stem and the valve bottom, wherein the first hollow space radially inward of the fluid-tight connection has a higher cooling agent filling level than the second hollow space, thereby causing a shaker effect in the first and second hollow spaces to enhance cooling, and wherein at least one of the valve disc and the valve stem has a nitriding layer.

2. The gas exchange valve according to claim 1, wherein at least one hollow space includes a cooling agent filled therein.

3. The gas exchange valve according to claim 2, wherein the cooling agent comprises sodium.

4. The gas exchange valve according to claim 1, wherein the valve stem has the nitriding layer.

5. The gas exchange valve according to claim 1, wherein the nitriding layer is between 1-20 μm thick.

6. The gas exchange valve according to claim 1, wherein the valve cone includes a wall thickness of 1.0 mm or less.

7. The gas exchange valve according to claim 1, wherein the first hollow space includes an inner diameter at least ⅔ of an outer diameter of the valve stem.

8. The gas exchange valve according to claim 1, wherein the gas exchange valve includes at least one of a 601H-steel, an 800H-steel, a 286-steel and a 602H-steel.

9. The gas exchange valve according to claim 1, wherein the valve stem at the connection to the valve bottom has a larger diameter than at the connection to the valve cone.

10. The gas exchange valve according to claim 1, wherein the nitriding layer is a superficial nitrided layer and an underlying material of the valve disc is steel.

11. The gas exchange valve according to claim 7, wherein the valve stem defines a first diameter at the connection with the valve bottom and a second diameter at the connection with the valve cone, wherein the first diameter is larger than the second diameter.

12. An internal combustion engine, comprising: at least one cylinder and at least one associated gas exchange valve, the gas exchange valve including:

a valve disc including a valve bottom and a hollow valve cone coupled to an outer periphery of the valve bottom, the valve cone tapering with increasing distance from the valve bottom to define an opening;

a hollow valve stem extending through the opening of the valve cone, the valve stem fixedly coupled to the valve bottom and the valve cone, wherein the valve stem is connected to the valve bottom on an end face adjoining the valve bottom to form a fluid-tight connection, the valve stem defining a first hollow space fluidically separated and radially inward from a second hollow space arranged in the valve disc;

wherein the first hollow space radially inward of the fluid-tight connection has a higher cooling agent filling level than the second hollow space; and wherein at least the valve bottom of the valve disc is composed of a steel material, and wherein the valve bottom includes a superficial nitrided layer.

13. The internal combustion engine according to claim 12, wherein at least one hollow space includes a cooling agent filled therein.

14. The internal combustion engine according to claim 12, wherein at least one of the valve cone further includes the superficial nitrided layer and the valve stem further includes the superficial nitrided layer.

15. The internal combustion engine according to claim 12, wherein the superficial nitrided layer has a thickness between 1-20 μm.

16. The internal combustion engine according to claim 12, wherein the valve cone includes a thickness of 1.0 mm or less.

17. The internal combustion engine according to claim 12, wherein the first hollow space includes an inner diameter of at least ⅔ an outer diameter of the valve stem.

18. The internal combustion engine according to claim 12, wherein the valve stem defines a first diameter at the coupling with the valve bottom and a second diameter at the coupling with the valve cone, wherein the first diameter is larger than the second diameter.

19. The gas exchange valve according to claim 11, wherein the valve cone includes a wall thickness of 1.0 mm or less.

20. A gas exchange valve for an internal combustion engine, comprising:

a valve disc including a valve bottom and a hollow valve cone coupled to an outer periphery of the valve bottom, the valve cone tapering with increasing distance from the valve bottom to define an opening;

a hollow valve stem extending through the opening of the valve cone, the valve stem fixedly connected to the valve bottom and the valve cone, wherein the valve stem is connected to the valve bottom on an end face adjoining the valve bottom to form a fluid-tight connection, the valve stem including a first diameter at the connection with the valve bottom and a second diameter at the connection with the valve cone, wherein the first diameter is larger than the second diameter;

wherein the valve stem defines a first hollow space fluidically separated and radially inward from a second hollow space arranged in the valve disc, the first hollow space radially inward of the fluid-tight connection having a higher cooling agent filling level than the second hollow space; and wherein at least the valve bottom includes a superficial nitrided layer having a hardness greater than that of an underlying material of the valve bottom.

* * * * *